US011116295B2

(12) United States Patent
Cho et al.

(10) Patent No.: US 11,116,295 B2
(45) Date of Patent: Sep. 14, 2021

(54) EASY-TO-DRAWING-IN UMBRELLA

(71) Applicant: Chin-Hsing Cho, Taiwan (CN)

(72) Inventors: Chin-Hsing Cho, Taiwan (CN); Wei-Jen Chen, Taiwan (CN); Chang-Cheng Lin, Taiwan (CN); Mei-Ling Chen, Taiwan (CN); Meng Jie Cui, Anhui (CN); Yang Yu, Heilongjiang (CN)

(73) Assignee: Chin-Hsing Cho, Taiwan (CN)

( * ) Notice: Subject to any disclaimer, the term of this patent is extended or adjusted under 35 U.S.C. 154(b) by 572 days.

(21) Appl. No.: 16/080,307

(22) PCT Filed: Jan. 17, 2018

(86) PCT No.: PCT/CN2018/073071
§ 371 (c)(1),
(2) Date: Aug. 28, 2018

(87) PCT Pub. No.: WO2019/024464
PCT Pub. Date: Feb. 7, 2019

(65) Prior Publication Data

US 2021/0196014 A1 Jul. 1, 2021

(30) Foreign Application Priority Data

Aug. 4, 2017 (CN) ..... 201720968502.2

(51) Int. Cl.
*A45B 19/10* (2006.01)
*A45B 25/12* (2006.01)
(Continued)

(52) U.S. Cl.
CPC ..... *A45B 19/10* (2013.01); *A45B 25/12* (2013.01); *A45B 25/165* (2013.01); *A45B 25/18* (2013.01); *A45B 2011/005* (2013.01)

(58) Field of Classification Search
CPC ..... A45B 19/10; A45B 25/12; A45B 25/18
See application file for complete search history.

(56) References Cited

U.S. PATENT DOCUMENTS 1,314,230 A * 8/1919 Weinberg ..... A45B 25/12 135/44
1,695,826 A * 12/1928 Sincere ..... A45B 25/02 135/33.4
(Continued)

FOREIGN PATENT DOCUMENTS

CN 201663985 12/2010
CN 202122209 1/2012
(Continued)

OTHER PUBLICATIONS

"International Search Report (Form PCT/ISA/210)", dated Apr. 23, 2018, pp. 1-5.

*Primary Examiner* — Noah Chandler Hawk
(74) *Attorney, Agent, or Firm* — JCIPRNET

(57) ABSTRACT

An easy-to-drawing-in umbrella includes an umbrella cloth, a rib and an umbrella stem. The umbrella cloth is arranged on the rib. The rib is arranged on a fixed end of the umbrella stem. The easy-to-drawing-in umbrella further includes a molded fixing assembly. The rib includes a folding support set and a rib nest. The folding support set is secured onto the rib nest. The rib nest is used to fix all supporters of the folding support set on the rib nest, and is fastened on the umbrella stem via the rib nest. The umbrella cloth is set with folds. The molded fixing piece assembly is arranged on one side of the folds.

6 Claims, 8 Drawing Sheets

(51) Int. Cl.

| | |
|---|---|
| ***A45B 25/16*** | (2006.01) |
| ***A45B 25/18*** | (2006.01) |
| *A45B 11/00* | (2006.01) |

(56) References Cited

U.S. PATENT DOCUMENTS

| | | | | | |
|---|---|---|---|---|---|
| 3,046,701 | A * | 7/1962 | Small | A45B 25/18 | 135/33.2 |
| 3,692,035 | A * | 9/1972 | Houston | A45B 25/18 | 135/33.2 |
| 3,957,070 | A * | 5/1976 | Pieper | A45B 25/18 | 135/33.2 |
| 6,079,430 | A * | 6/2000 | Yamamoto | A45B 25/18 | 135/15.1 |
| 10,743,626 | B2 * | 8/2020 | Cho | A45B 11/00 | |
| 2018/0168300 | A1 * | 6/2018 | Mundt | A45B 25/18 | |

FOREIGN PATENT DOCUMENTS

| | | |
|---|---|---|
| CN | 203618915 | 6/2014 |
| CN | 205658492 | 10/2016 |
| CN | 106174943 | 12/2016 |
| CN | 206025474 | 3/2017 |
| CN | 206137417 | 5/2017 |
| CN | 107242656 | 10/2017 |
| CN | 107348642 | 11/2017 |
| JP | H10327918 | 12/1998 |

* cited by examiner

EASY-TO-DRAWING-IN UMBRELLA

CROSS-REFERENCE TO RELATED APPLICATION

This is a 371 application of the International PCT application serial no. PCT/CN2018/073071, filed on Jan. 17, 2018, which claims the priority benefits of China Application No. 201720968502.2, filed on Aug. 4, 2017. The entirety of each of the above-mentioned patent applications is hereby incorporated by reference herein and made a part of this specification.

FIELD OF THE INVENTION

This invention relates to the field of umbrella, and in particular, an easy-to-drawing-in umbrella.

DESCRIPTION OF RELATED ART

In general, a triple-fold umbrella or a multi-fold umbrella is retracted manually. Folds will appear more or less after the umbrella is used; therefore, it is required to put the umbrella fabric in order manually, and then fold the ribs and bind it up with a tie band, and finally place the umbrella into a pouch. However, it is quite time-consuming to draw the umbrella in, and it is unaesthetic if drawn-in in such manner. If the umbrella is not drawn in, it will not only make the umbrella cloth become dirty, but also reduce its service life.

SUMMARY OF THE INVENTION

The technical issue to be resolved by the invention lies in the provision of an easy-to-drawing-in umbrella to solve the problem that it is complicated to draw in the umbrella.

This invention is realized in such manner that: An easy-to-drawing-in umbrella includes an umbrella cloth, a rib and an umbrella stem. The umbrella cloth is arranged on the rib. The rib is arranged on the fixed end of the umbrella stem. The easy-to-drawing-in umbrella further includes a molded fixing piece assembly. The rib includes a folding support set and a rib nest. The folding support set is secured onto the rib nest. The rib nest is used to fix all supporters of the folding support set on the rib nest, and is fastened on the umbrella stem via the rib nest. The umbrella cloth is set with folds. The molded fixing piece assembly is arranged on one side of the folds.

Further, the folds are straight-line umbrella cloth folds that take a center of circle thereof as a starting point and are arrayed by extending outward of the umbrella cloth, circular umbrella cloth folds set on the umbrella cloth that take a central point as the center of circle and/or a rib cloth folds that are secured on the rib.

Further, the umbrella is a triple-fold umbrella. The circular umbrella cloth has two folds. The molded fixing piece assembly includes an internal molded fixing piece, a medium molded fixing piece and an external molded fixing piece. The internal molded fixing piece is set on the umbrella cloth inside the innermost circular umbrella cloth fold. The medium molded fixing piece is set on the umbrella cloth between the two circular umbrella cloth folds. The external molded fixing piece is set on the umbrella cloth outside the outermost circular umbrella cloth fold.

Further, the molded fixing piece assembly is a PU molded fixing piece assembly, a TPU molded fixing piece assembly, a PET molded fixing piece assembly, a PE molded fixing piece assembly, a PP molded fixing piece assembly, an ABS molded fixing piece assembly, a PVC molded fixing piece assembly or a silicone molded fixing piece assembly.

Further, the folding support set is a triple-fold folding support set, a double-fold folding support set or a quadruple-fold folding support set.

Further, the umbrella is a manually-open umbrella, an automatically-open umbrella or an electrically-open umbrella.

Further, the umbrella is a rain umbrella or a sunshade.

Further, the easy-to drawing-in umbrella further includes a tie band. The tie band is set on an outside surface of the umbrella cloth. The tie band is used to fix the umbrella cloth after the umbrella is drawn in and folded.

The invention has following advantages: Differing from the existing umbrella, which requires drawing in manually. While it is more cumbersome when drawing in the umbrella manually, it is time-consuming. The umbrella adopting this technical proposal can draw in regularly to some extent initially based on the folding lines on the umbrella. Also, the inner side of the umbrella cloth is set with the molded fixing piece assembly, by which a rigidity of the umbrella cloth at the place where such molded fixing piece assembly is located and the flatness of the surface of the umbrella cloth. Furthermore, as the molded fixing piece assembly is distributed at one side of the fold lines, it can guarantee that the position of the folds on the umbrella cloth maintains unchanged. Therefore, when drawing in the umbrella, it can be drawn in regularly based on the molded fixing piece assembly and the folds, which can guarantee the flatness of the umbrella fabric, but also improve the speed to draw in the umbrella, and in such case, it does not need to arrange the umbrella cloth manually, thus avoiding the waste of time.

DETAILED DESCRIPTION OF THE PREFERRED EMBODIMENTS

Figure 1:
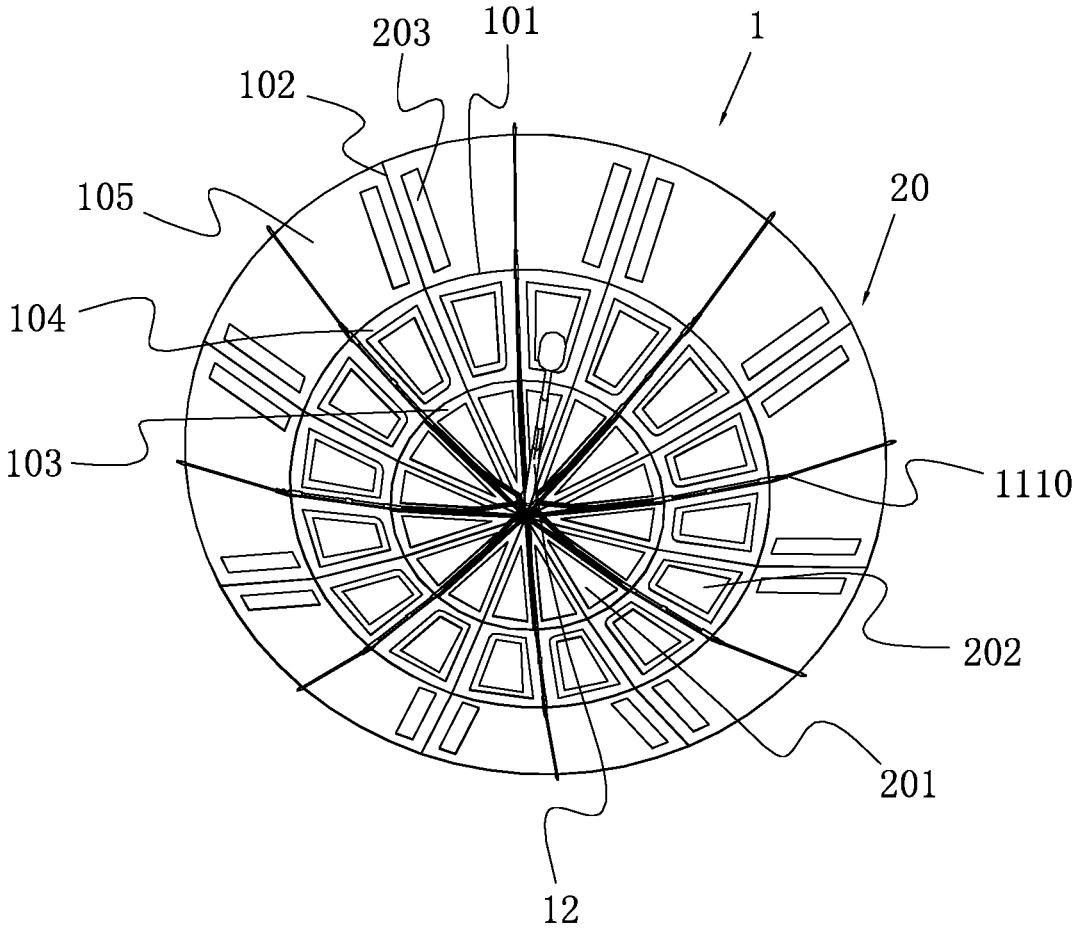
FIG. 1 is a structural schematic drawing of an easy-to-drawing-in triple-fold umbrella in a preferred embodiment of this invention.

In order to describe the related art, structural features, accomplished purpose and performance in details, the description is made by combining the preferred embodiments and drawings.

Please refer to FIG. 1 to FIG. 8, this invention relates to an easy-to-drawing-in umbrella, which includes an umbrella cloth 10, a rib 11 and an umbrella stem 12. The umbrella cloth is arranged on the rib, and the rib is arranged on a fixed end of the umbrella stem 12. The easy-to-drawing-in umbrella further includes a molded fixing piece assembly 20. The rib 11 includes a folding support set 111 and a rib nest 112. The folding support set is secured onto the rib nest. The rib nest is used to fix all supporters of the folding support set on the rib nest, and is fastened on the umbrella stem via the rib nest. The umbrella cloth is set with folds. The molded fixing piece assembly is arranged on one side of the fold.

The easy-to-drawing-in umbrella adopting this technical proposal provides people with a quick folding umbrella, which is to draw in and fold the umbrella regularly based on the folds on the umbrella cloth when retracting the umbrella after people use it. As the umbrella cloth is set with the molded fixing piece assembly on an internal surface at a side near the fold, and such molded fixing piece assembly is set close to the fold, so that the position of the folds on the umbrella cloth maintains unchanged after used for many times, and it can also keep the surface where such molded fixing piece assembly is located flat. Therefore, when retracting the folding support set through the rib nest, the umbrella cloth on the folding support set will draw in and fold regularly based on the folds of the umbrella cloth, thus folding the umbrella quickly.

The folding support set adopting this technical proposal is a triple-fold folding support set, a double-fold folding support set or a quadruple-fold folding support set. As shown in FIG. 1, the fold are straight-line umbrella cloth folds 102 that take its center of circle as a starting point and are arrayed by extending outward of the umbrella cloth, circular umbrella cloth folds 101 set on the umbrella cloth that take a central point as the center of circle and/or rib cloth folds 100 that is secured on the rib 11. If the umbrella is a triple-fold umbrella, the circular umbrella cloth has two folds. The circular umbrella cloth fold is located at a folding node of the folding support set. The molded fixing piece assembly includes an internal molded fixing piece 201, a medium molded fixing piece 202 and an external molded fixing piece 203. The internal molded fixing piece is set on the umbrella cloth inside the innermost circular umbrella cloth fold. The medium molded fixing piece is set on the umbrella cloth between the two circular umbrella cloth folds. The external molded fixing piece is set on the umbrella cloth outside the outermost circular umbrella cloth fold. Meanwhile, based on the division of the circular umbrella cloth fold, the umbrella cloth inside the innermost circular umbrella cloth fold is an internal umbrella cloth 103. The umbrella cloth between two circular umbrella cloths is a medium umbrella cloth 104. The umbrella cloth outside the outermost circular umbrella cloth fold is an external umbrella cloth 105.

To be specific, the umbrella in this preferred embodiment includes the umbrella cloth, the ribs, the umbrella stem, a tie band, a handle and the molded fixing piece assembly. The umbrella stem is connected to the ribs at one end, while its other end is connected to the handle, and the umbrella can be a telescopic pole, so that the umbrella can retract its umbrella stem while retracting. The umbrella cloth is secured on the ribs, by tying with lines or ropes onto the ribs, and a central position to fasten the umbrella cloth via the umbrella hat is set above a notch. The tie band, which is used to bind and fasten the umbrella cloth when retracting the umbrella, is secured on an external surface of the umbrella cloth. In order to improve the uniformity of the umbrella, the umbrella cloth is set with folds. The fold can be divided into the circular umbrella cloth fold and the straight-line umbrella cloth fold. The circular umbrella cloth fold forms a circle around the central point of the umbrella cloth, and sets the circular folds with the same center of the circle taking the support node of the folding support set of the rib as the radius. The number of the circular umbrella cloth fold can be configured based on the number of the support node of the folding support set. For example, there are two support nodes of the folding support set for the triple-fold umbrella, and then two circular umbrella cloth folds are set. While the straight-line umbrella cloth fold is set with folding lines dispersing by taking the central point of the umbrella cloth as the starting point, and the number of the straight-line umbrella cloth folds is the same as that of the supporters of the folding support set. In addition, the straight-line umbrella cloth fold is located at a middle position between supporter and supporter of the folding support set.

The umbrella can be divided into the internal umbrella cloth, the medium umbrella cloth and the external umbrella cloth based on the circular umbrella cloth folds. And then, different layers of umbrella cloth are set with molded fixing piece assembly, which includes the internal molded fixing piece, the medium molded fixing piece and the external molded fixing piece, and they are arranged correspondingly on the internal umbrella cloth, the medium umbrella cloth and the external umbrella cloth respectively. The internal molded fixing piece is divided into a delta-shaped region by the fold and the supporters 1110 of the folding support set of the internal umbrella cloth. Therefore, the internal molded fixing piece is set into a triangular shape, a trapezoidal shape or a triangular-framed shape, so that such internal molded fixing piece is pasted onto the internal surface of the umbrella cloth. Moreover, as to the internal umbrella cloth, the area of its delta-shaped region will be different due to the number of supporters of the folding support set. If the area of such delta-shaped region is relatively small, the internal molded fixing piece may not be fastened by pasting. The medium umbrella cloth is divided into a trapezoidal shape by the cloth folds and the supporters of the folding support set, so that the trapezoidal molded fixing piece, the trapezoidal-framed molded fixing piece or the stripe-shaped molded fixing piece is pasted onto the internal surface of the umbrella cloth. Moreover, the folding number of the folding support set is different, so the layers of the medium molded fixing piece can be increased or decreased. For example, the quadruple-fold umbrella has two medium molded fixing pieces, while the double-fold umbrella is not set with medium molded fixing piece. As for the external umbrella cloth, as the area between the umbrella cloth fold of the external umbrella cloth and the supporters of the folding support set is relatively large, and the internal layer and the medium layer of the umbrella cloth are pasted with internal molded fixing piece and the medium molded fixing piece respectively. Therefore, it only requires pasting the external molded fixing piece at one side of the straight-line umbrella cloth fold of the external umbrella cloth. By such setting, it can not only reduce an overall weight of the umbrella, but also can fold the umbrella based on the folding inertia and the folds.

The molded fixing piece assembly is set at one side of the straight-line umbrella cloth fold as well as at one side of the circular umbrella cloth fold. Therefore, the fold of the umbrella cloth can maintain unchanged due to the use of umbrella. When folding the umbrella, it can also keep the umbrella fabric flat and improve the rigidity of the umbrella fabric through the folded fixing piece as well. So when folding the umbrella, the umbrella cloth will fold regularly based on the folds, so that people do not need to place the umbrella cloth piece by piece when retracting the umbrella. People need to do is to bind up and fasten the umbrella cloth by tie band after retracting the umbrella, and finally place into the umbrella pouch. By such way, it can avoid the cumbersome process of retracting the umbrella, but also improve the efficiency of retracting the umbrella.

Figure 2:
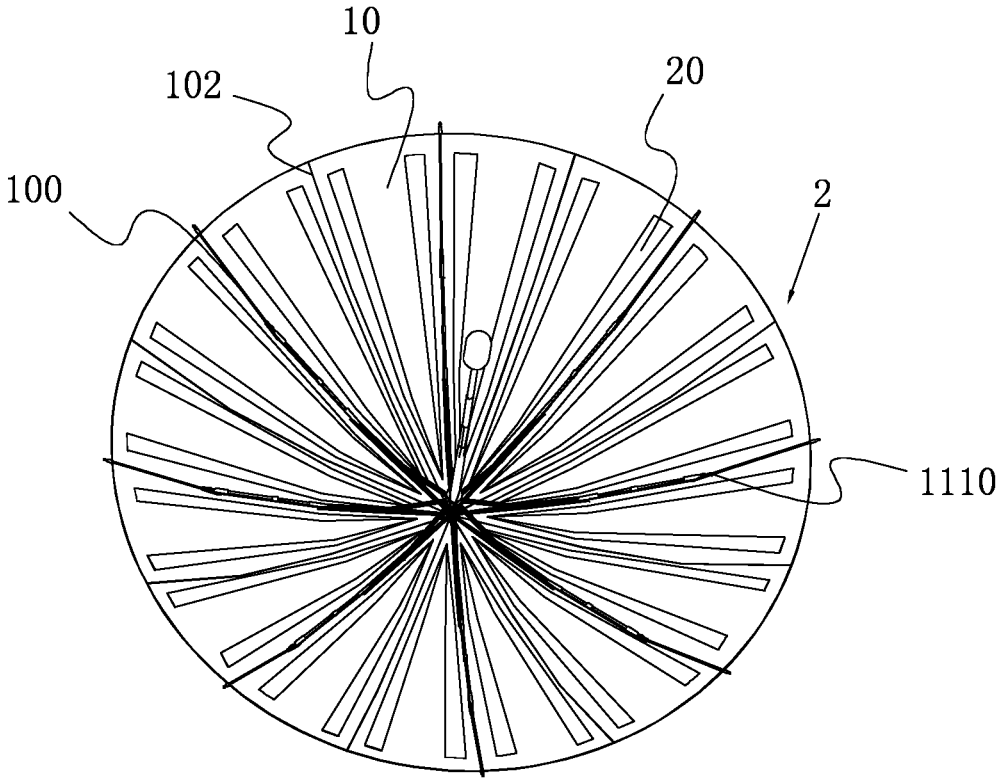
FIG. 2 is a structural schematic drawing of the easy-to-drawing-in straight umbrella in the preferred embodiment of this invention.
Figure 3:
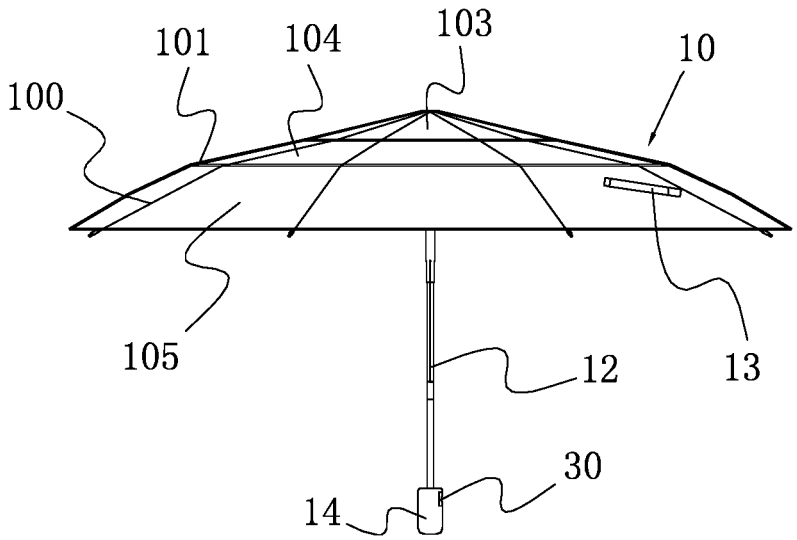
FIG. 3 is a side view of the easy-to-drawing-in umbrella in the preferred embodiment of this invention.

As shown in FIG. 2, the fold of the straight umbrella 2 is set with a molded fixing piece assembly at the support of the rib, and its folding principle is the same as that of the triple-fold umbrella, which is to maintain the folds of the straight umbrella unchanged after used for many times by the molded fixing piece assembly, and it is set where the molded fixing piece assembly is located, which can maintain the umbrella fabric flat, and also, when folding the umbrella, it can draw the umbrella in based on the folds, thus folding the umbrella quickly.

Figure 6:
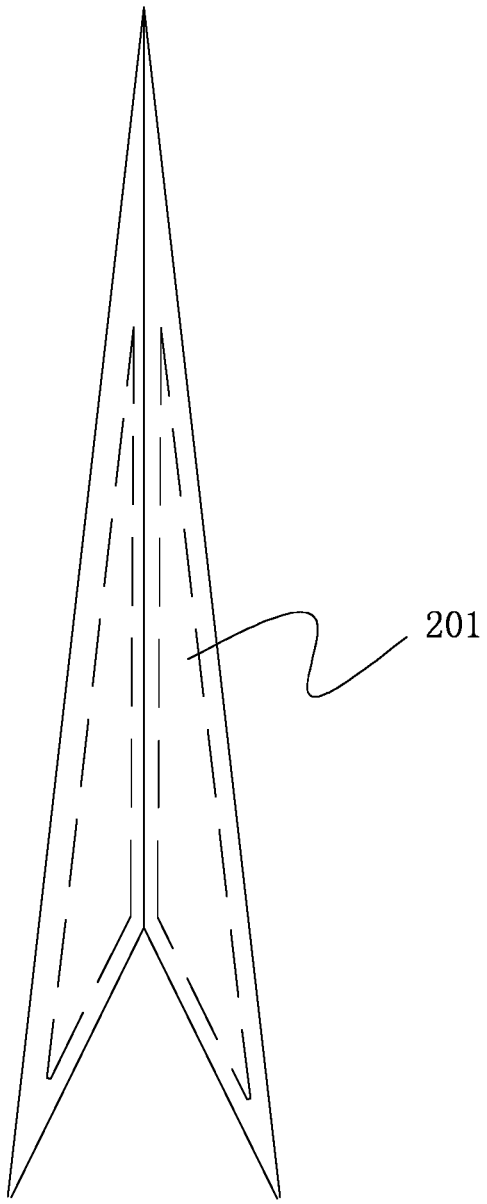
FIG. 6 is a schematic drawing of the internal molded fixing piece of the easy-to-drawing-in umbrella in the preferred embodiment of this invention.
Figure 7:
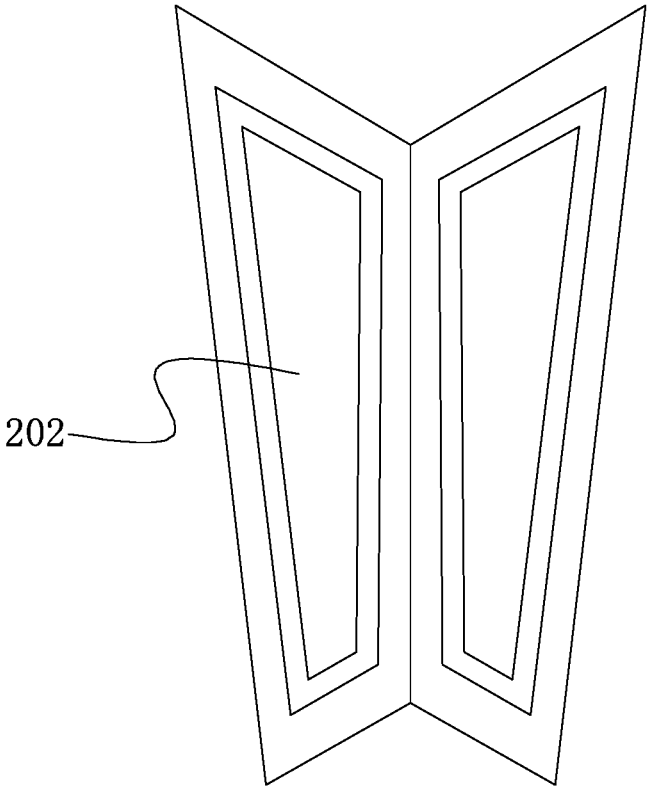
FIG. 7 is a schematic drawing of the medium molded fixing piece of the easy-to-drawing-in umbrella in the preferred embodiment of this invention.
Figure 8:
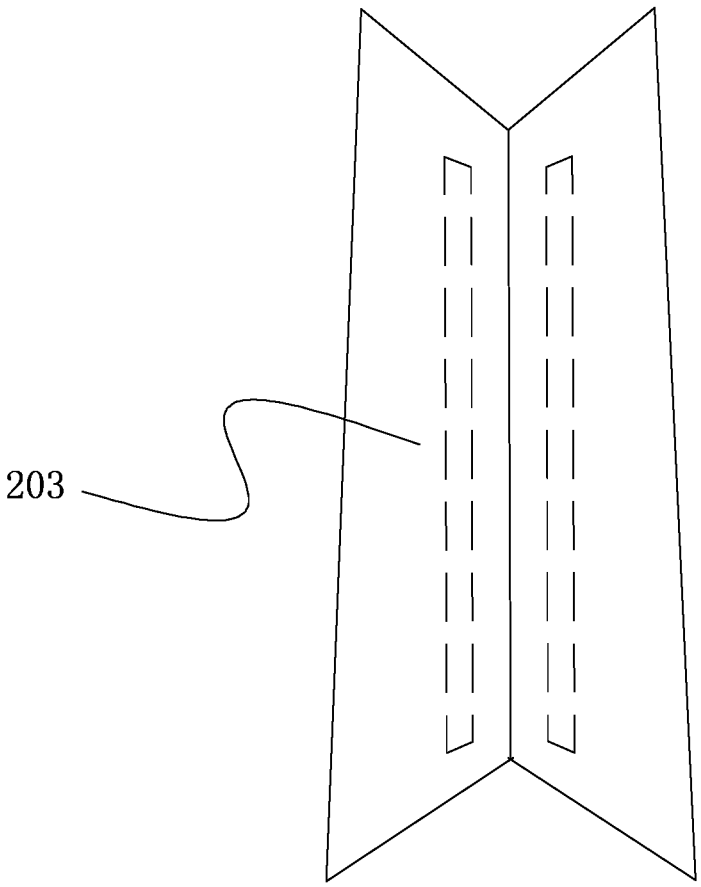
FIG. 8 is a schematic drawing of the external molded fixing piece of the easy-to-drawing-in umbrella in the preferred embodiment of this invention.

As shown in FIG. 6, FIG. 7 and FIG. 8, the hardness of the molded fixing piece assembly stated in this technical proposal is greater than the fixing flap of the umbrella cloth, which can be a nonmagnetic fixing flap, such as the plastic sheet, the silicone sheet or rubber sheet. More specifically, it can be PU molded fixing piece assembly, TPU molded fixing piece assembly, PET molded fixing piece assembly, PE molded fixing piece assembly, PP molded fixing piece assembly, ABS molded fixing piece assembly, PVC molded fixing piece or silicone molded fixing piece. PU, the abbreviation of polyurethane (with its English name as: polyurethane) refers to the polyurethane material, which is a high-molecular material. TPU (with its English name as: Thermoplastic polyurethanes) refers to the thermoplastic polyurethanes. PET (with its English name as: Polyethylene terephthalate) refers to the polyethylene terephthalate. PE (with its English name as: polyethylene) is a kind of thermoplastic resin obtained by aggregating the ethylene. PP (with its English name as: Polypropylene) refers to the polypropylene, which is also a thermoplastic resin by aggregating the propylene. ABS (with its English name as: acrylonitrile-butadiene-styrene copolymer) is a kind of synthetic resin. PVC (with its English name as: is polyvinyl chloride) refers to the compound polyvinyl chloride in terms of chemical sector. As a result, the molded fixing assembly can be made by different materials; meanwhile, the molded fixing assembly can be made of softer materials, thus avoiding the molded fixing assembly from cutting into the umbrella cloth, or it may lead to the cuts to the users by such molded fixing assembly. Furthermore, the molded fixing assembly can be set on the umbrella cloth by fitting or coating. The molded fixing assembly can be set a certain shape according to different positions of the umbrella cloth, thus making the thickness of the umbrella different. Therefore, a hardness of the umbrella at different positions varies, so that it will be faster for people to draw in the folding umbrella. The external surface or the internal surface of the umbrella can be coated fully by the materials similar to PU, thus preventing the UV (with its English name as Ultraviolet, namely the UV light).

Figure 4:
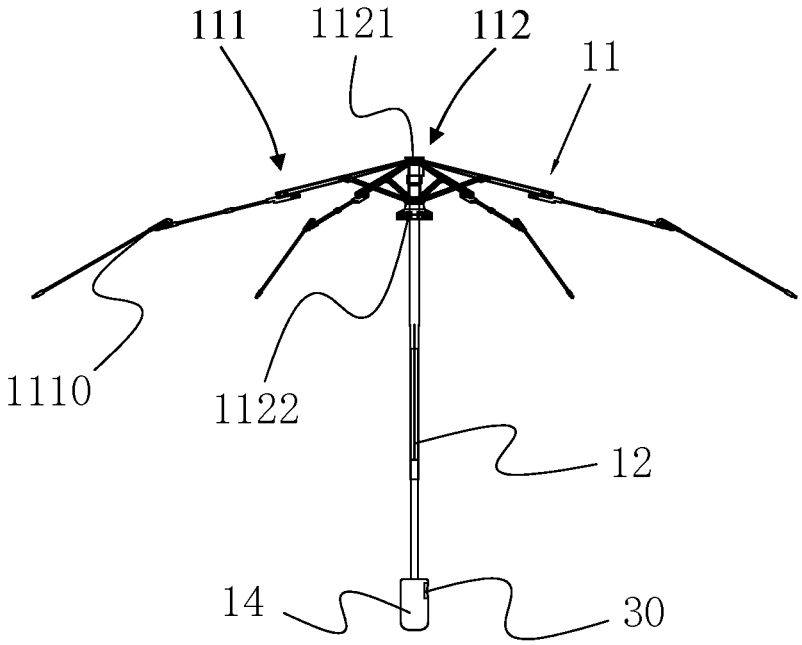
FIG. 4 is a structural drawing of the easy-to-drawing-in umbrella rib in the preferred embodiment of this invention.
Figure 5:
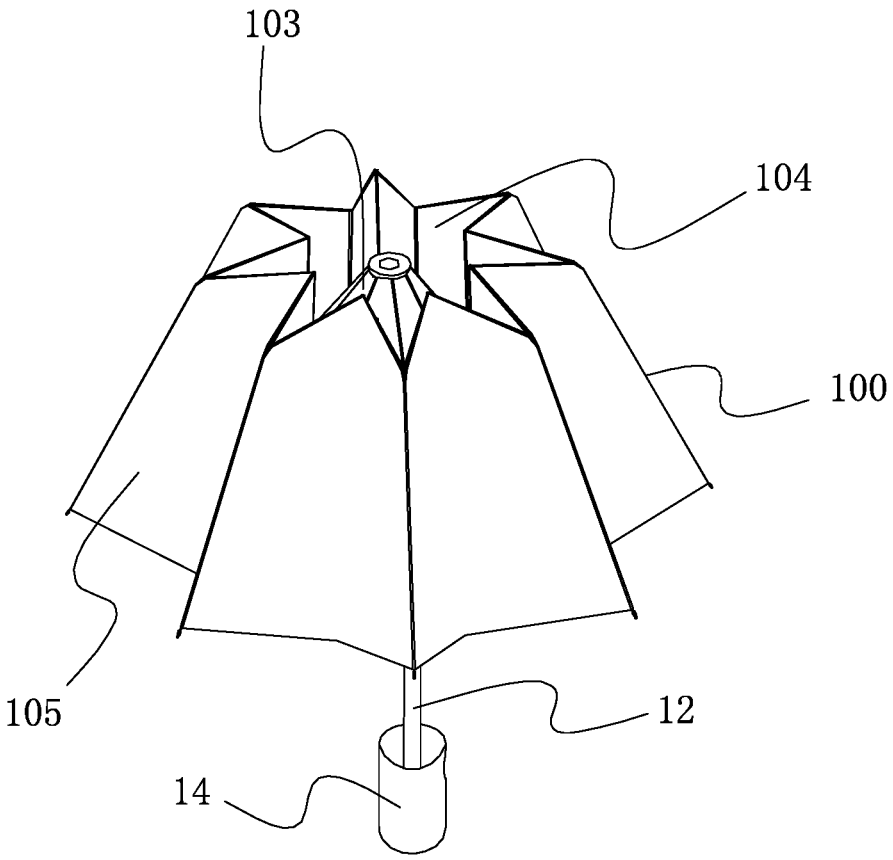
FIG. 5 is a schematic drawing of the easy-to-drawing-in triple-fold umbrella at drawing-in in the preferred embodiment of this invention.

The umbrella stated in this technical proposal can be a manually-open umbrella, an automatically-open umbrella or an electrically-open umbrella. The umbrella may be a rain umbrella or a sunshade. As shown in FIG. 4, the umbrella further includes a tie band 13, which is set on the outside surface of the umbrella cloth, and the tie band is used to fix the umbrella cloth after the umbrella is drawn in and folded. The rib nest includes the notch 1121 and a runner 1122, wherein the notch is set on an end face of the fixed end of the umbrella stem, while the runner is set on a rod end of a driving rod as well as on the umbrella stem. The rib nest can be fastened on one end of the umbrella stem via the notch of the rib nest. While the runner is set on the umbrella stem movably, and put up or draw in the umbrella ribs by pushing the runner. The rain umbrella or the sunshade can be set with a handle 14 on the connecting end of the umbrella stem, so as to facilitate people to take the rain umbrella or the sunshade. The self-opening umbrella or the electric umbrella can be set with a push button 30 on the handle, by which the opening/closing of the umbrella can be controlled so as to facilitate the use of umbrella by people. After drawing in and folding the umbrella, the tie band is used to bind the umbrella, thus placing the umbrella into the umbrella bag.

It should be noted that in this article, the term related to the first, the second and other similar relationship is only to distinguish one entity or operation and another entity or operation, but necessarily requires or imply that these entities or operations have such actual relationship or order. In addition, the term "comprising", "including" or any other variants intends to cover a non-exclusive inclusion; therefore, the process, the method, the material or the terminal device containing a series of elements can not only include those elements, but also other elements that are not explicitly listed herein, or the inherent elements of such process, method, material or terminal device. In the absence of more restrictions, the elements restricted by the statement of "comprising" or "including" do not exclude other elements contained in the process, method, material or terminal device of the said elements. In addition, the term "greater than", "less than", "more than" or others shall be construed as non-inclusion of the figure per se; "above", "below", "under" or others can be construed as inclusion of the figure per se.

Although the embodiments have been described above, once those skilled in the art understand basic creative concept, they can make additional modification and alteration for these embodiments; therefore . . . , the above description is only the embodiments of the invention, but not intended to limit the scope of the patent protection of this invention, any equivalent structure or equivalent process modification used according to the contents of the specification and accompanying drawings in this invention, no matter whether it is directly or indirectly used in any other related technical field, should be included within the scope of patent protection herein.

What is claimed is:

1. An easy-to-drawing-in umbrella comprising an umbrella cloth, a rib and an umbrella stem, wherein the umbrella cloth is arranged on the rib, and the rib is arranged on a fixed end of the umbrella stem, the easy-to-drawing-in umbrella further comprising a molded fixing piece assembly, wherein the rib includes a folding support set and a rib nest, and the folding support set is secured onto the rib nest;

wherein, the rib nest is used to fix all supporters of the folding support set on the rib nest, and is fastened on the umbrella stem via the rib nest; and wherein, the umbrella cloth is set with folds, and the molded fixing piece assembly is arranged on one side of the folds, the folds are straight-line umbrella cloth folds that take a center of circle thereof as a starting point and that are arrayed by extending outward of the umbrella cloth, circular umbrella cloth folds set on the umbrella cloth that take a central point as the center of circle and/or rib cloth folds that are secured on the rib, the umbrella is a triple-fold umbrella, a number of the circular umbrella cloth folds is two, and the molded fixing piece assembly includes an internal molded fixing piece, a medium molded fixing piece and an external molded fixing piece, wherein the internal molded fixing piece is set on the umbrella cloth inside an innermost circular umbrella cloth fold, the medium molded fixing piece is set on the umbrella cloth between the two circular umbrella cloth folds, and the external molded fixing piece is set on the umbrella cloth outside an outermost circular umbrella cloth fold.

2. An easy-to-drawing-in umbrella according to claim 1, wherein the molded fixing piece assembly is a PU molded fixing piece assembly, a TPU molded fixing piece assembly, a PET molded fixing piece assembly, a PE molded fixing piece assembly, a PP molded fixing piece assembly, an ABS molded fixing piece assembly, a PVC molded fixing piece assembly or a silicone molded fixing piece assembly.

3. An easy-to-drawing-in umbrella according to claim 1, wherein the folding support set is a triple-fold folding support set, a double-fold folding support set or a quadruple-fold folding support set.

4. An easy-to-drawing-in umbrella according to claim 1, wherein the umbrella is a manually-open umbrella, an automatically-open umbrella or an electrically-open umbrella.

5. An easy-to-drawing-in umbrella according to claim 1, wherein the umbrella is a rain umbrella or a sunshade.

6. An easy-to-drawing-in umbrella according to claim 1, further comprising a tie band, wherein the tie band is set on an outside surface of the umbrella cloth, and the tie band is used to fix the umbrella cloth after the umbrella is drawn in and folded.

* * * * *